United States Patent [19]

Genthe et al.

[11] 4,173,409

[45] Nov. 6, 1979

[54] ELECTROSTATIC COPIER INCLUDING PHOTORECEPTOR STORING APPARATUS

[75] Inventors: James E. Genthe, Newtown; Douglas I. Morrison, Norwalk, both of Conn.

[73] Assignee: Pitney-Bowes, Inc., Stamford, Conn.

[21] Appl. No.: 743,781

[22] Filed: Nov. 22, 1976

[51] Int. Cl.[2] ..... G03G 15/00

[52] U.S. Cl. ..... 355/16; 226/119; 355/3 BE

[58] Field of Search ..... 355/16, 3 BE; 226/119, 226/118; 270/61 F, 79

[56] References Cited

U.S. PATENT DOCUMENTS 4,077,713 3/1978 Vercoulen ..... 355/16

*Primary Examiner*—R. L. Moses

*Attorney, Agent, or Firm*—Martin D. Wittstein; William D. Soltow, Jr.; Albert W. Scribner

[57] ABSTRACT

In a copier including a flexible, endless web-type photoreceptor, and including suitable means for successively advancing the photoreceptor from a storage station and through several processing stations and back to the storage station, there is provided storing apparatus for supporting a major portion of the photoreceptor at the storage station in the form of a series of interconnected U-shaped loops. The supporting apparatus includes a plurality of loop supports, from which the photoreceptor loops are individually hung. In addition, the storing apparatus includes means for intermittently moving the loop supports and thus the photoreceptor loops in timed relation to advancement of the photoreceptor to and from the storage station.

8 Claims, 9 Drawing Figures

ELECTROSTATIC COPIER INCLUDING PHOTORECEPTOR STORING APPARATUS

BACKGROUND OF THE INVENTION

Electrostatic copiers have been provided with endless-web-type photoreceptors; and with suitable means for advancing the photoreceptors from a storage station through several processing stations and then back to the storage station; and with suitable means for storing the photoreceptor at the storage station. For example, in the copier disclosed in U.S. Pat. No. 3,481,048, issued Mar. 16, 1976, there is disclosed apparatus for storing a photoreceptor having a plurality of sections in a stack. Such apparatus includes an elongated receptacle having a generally U-shaped transverse cross-section formed by a pair of oppositely disposed walls. The walls define an upper inlet opening through which processed photoreceptor sections are successively fed to the top of the stack, and a lower outlet opening through which stored photoreceptor sections are successively fed from the bottom of the stack. The receptacle walls extend downwardly and convergently toward one another from the inlet opening to the outlet opening, for guiding the folds of the photoreceptor sections progressively closer to the outlet opening than the mid-portions thereof in transit through the receptacle. With this arrangement the stack is bowed upwardly within the receptacle to facilitate feeding the sections from the bottom of the stack. The photoreceptor storing apparatus also includes a pair of tamping devices, slidably attached to the opposite receptacle walls, and a pair of suitably driven rocker arms arranged to alternately lift and lower the tamping devices against the opposite folds of the photoreceptor sections as they are fed to the top of the stack. The tamping devices thus cooperate with the receptacle walls in guiding the folds of the photoreceptor sections below the level of their respective mid-portions.

In the above described arrangement of apparatus the photoreceptor sections move in surface to surface contact with each other when stored in the stack. As a consequence, the photoconductive surfaces of photoreceptor sections are abraded, which may result in premature termination of the usefulness of the photoreceptor. In addition, the photoreceptor sections often become sufficiently triboelectrically charged during storage that they cannot thereafter be uniformly charged prior to imaging with the result that inferior images are formed on the photoreceptor sections. In addition, since the photoreceptor is not transported through the storage station, but rather is guided both to and through the same, the storing apparatus tends to permit a build-up of photoreceptor sections at the entry to the receptacle, as a result of which the photoreceptor is easily damaged.

Further, although there are other factors which contribute to low copy-per-minute speeds of the copier, since the photoreceptor structurally comprises a plurality of sections adapted to be stored in zig-zag folded stack in the receptacle, the photoreceptor includes a series of sharp folds rather than wavy loops formed in the same at spaced intervals along its length, which may ultimately limit the speed of feeding the photoreceptor to and away from the storage station; thereby limiting the reproductive capacity of the copier to relatively low copy-per-minute speeds. Of course, since the aforesaid zig-zag folds eventually weaken, they impose a limitation on the useful life of the photoreceptor. Further the zig-zag folds respectively constitute portions of the length of the photoreceptor on which images cannot be formed, as a consequence of which the control system of the copier must continuously recognize the presence of the folds in the course of advancement of the photoreceptor through the various processing instrumentalities of the copier, in order to timely operate the various instrumentalities in synchronism with advancement of a given photoreceptor section.

SUMMARY OF THE INVENTION

An object of the present invention is to provide an improved copier;

Another object is to provide a copier, having an endless web-type photoreceptor, with means for supporting and moving a major portion of the photoreceptor in the form of a plurality of wavy loops.

Yet another object of the present invention is to provide an improved copier which avoids the disadvantages of prior art copiers as above discussed without loss of the significant photoreceptor storage feature thereof;

Another object of the present invention is to provide an improved copier in which a plurality of sections of an endless web-type photoreceptor are stored in such a manner which substantially eliminates surface to surface contact between adjacent sections of the photoreceptor;

Another object of the present invention is to provide an improved copier in which a plurality of sections of an endless web-type photoreceptor are stored in such a manner which eliminates the need for sharp, spaced crease lines or folds between adjacent sections of the photoreceptor; and Another object of the present invention is to provide an improved copier in which the major portion of the length of an endless web-type photoreceptor is stored and intermittently transported to and through a storage facility in a manner which prevents any possibility for the photoreceptor to build up and jam at the entry to the storage facility.

Thus there is hereinafter described a copier of the type which utilizes a flexible, endless web-type photoreceptor and includes means for advancing the photoreceptor to and from a storage station. The copier is provided with apparatus at the storage station for storing a major portion of the photoreceptor in the form of a plurality of wavy loops. The storing apparatus includes means for supporting the loops and means for intermittently moving the supported loops, without lengthwise moving the loop relative to each other, through the storage station in timed relationship to advancement lengthwise of the photoreceptor to and from the storage station.

BRIEF DESCRIPTION OF THE DRAWINGS

As shown in the drawings, wherein like reference numerals designate like or corresponding parts throughout the several Figures.

DESCRIPTION OF THE PREFERRED EMBODIMENTS

Figure 1:
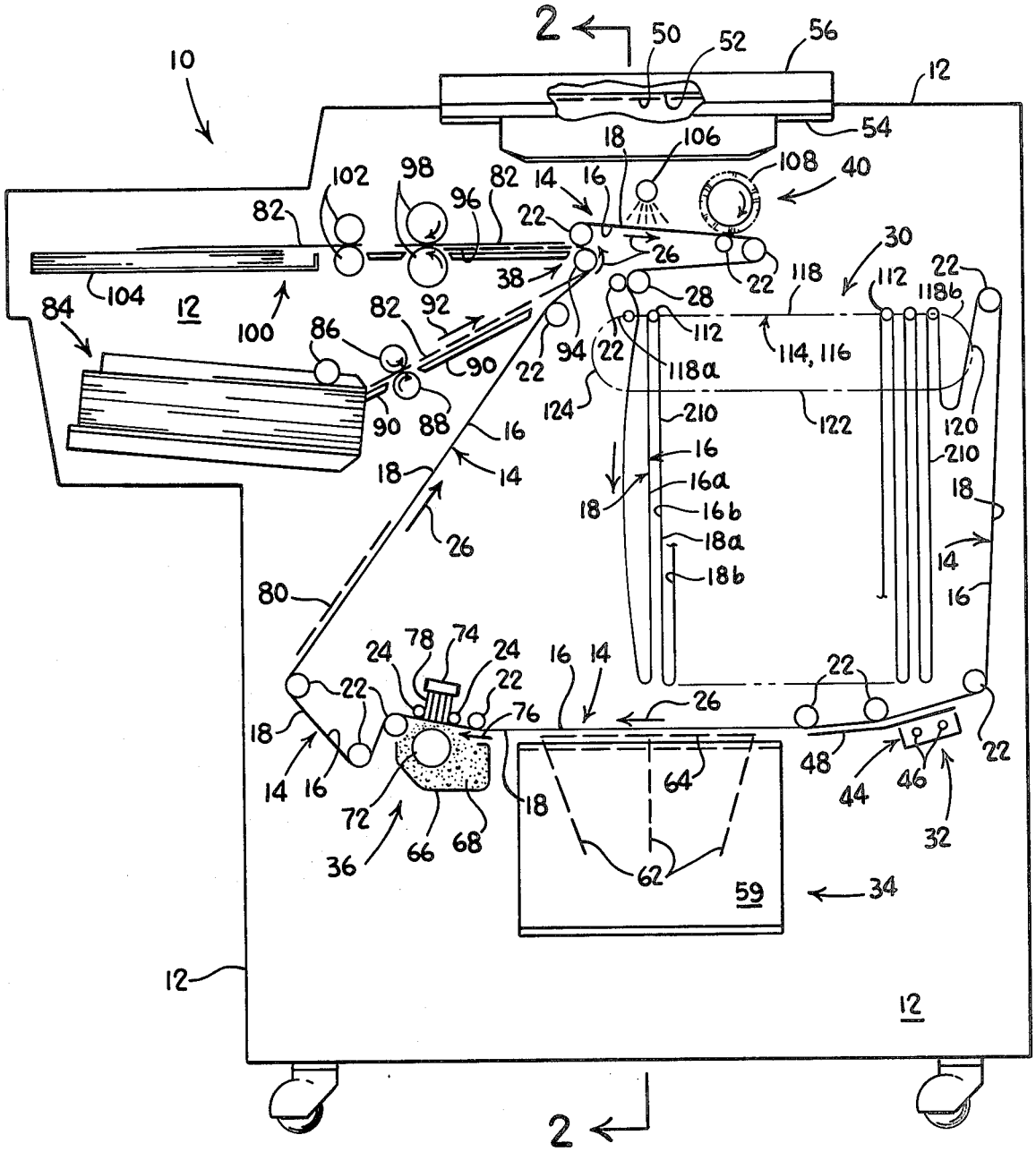
FIG. 1 is a schematic diagram, in elevation, of an electrostatic copier in accordance with the invention.

As shown in FIG. 1, an electrostatic copier 10 in accordance with the present invention, generally includes suitable framework 12 for supporting the various processing means of the copier 10, including a photoreceptor 14.

The photoreceptor 14 comprises a flexible endless web having a single transverse seam (not shown), and having an inner surface 16 and an outer surface 18. The outer surface 18 is coated with a suitable photoconductive powder such as an oxide of zinc dispersed in a suitable binder either alone or in combination with a suitable plasticizer and a suitable dye sensitizer for extending the light sensitivity of the coating.

To movably support the photoreceptor 14 (FIG. 1) within the copier 12, the processing means includes a plurality of elongated stationary guide shafts or rotatable idler shafts, all of which are designated 22, about which the photoreceptor 14 is suitably endlessly looped, and a plurality elongated guide shafts 24. The shafts 22 and 24 are disposed parallel to one another and suitably secured to the framework 12 so as to longitudinally extend transverse to a desired path of travel 26 of the moving photoreceptor 14. In addition, the processing means includes an elongated rotatable shaft 28 suitably driven from a source of supply of motive power (not shown). The driven shaft 28 is suitably secured to the framework 12 so as to extend parallel to the respective shafts 22 and rotate in engagement with the outer surface 18 of the photoreceptor 14. In response to actuation by the operator of suitable control means (not shown) adapted to automatically timely operate the various processing means of the copier, the driven shaft 28 moves the photoreceptor 14 in the aforesaid path of travel 26, from a storage station 30, through a charging station 32, imaging station 34, developing station 36, transferring station 38 and cleaning station 40 and back to the storage station 30.

At the charging station 32 (FIG. 1), the processing means includes a suitably electrically energizeable corona charging device 44 including a pair of elongated, high-voltage, charging electrodes 46, suitably spaced from the moving photoreceptor 14 and oriented relative to the same so as to longitudinally extend transverse to the photoreceptor's path of travel 26, for depositing a uniformly distributed array of electrostatic charge 48 of suitable polarity on the photoreceptor's outer surface 18.

Figure 2:
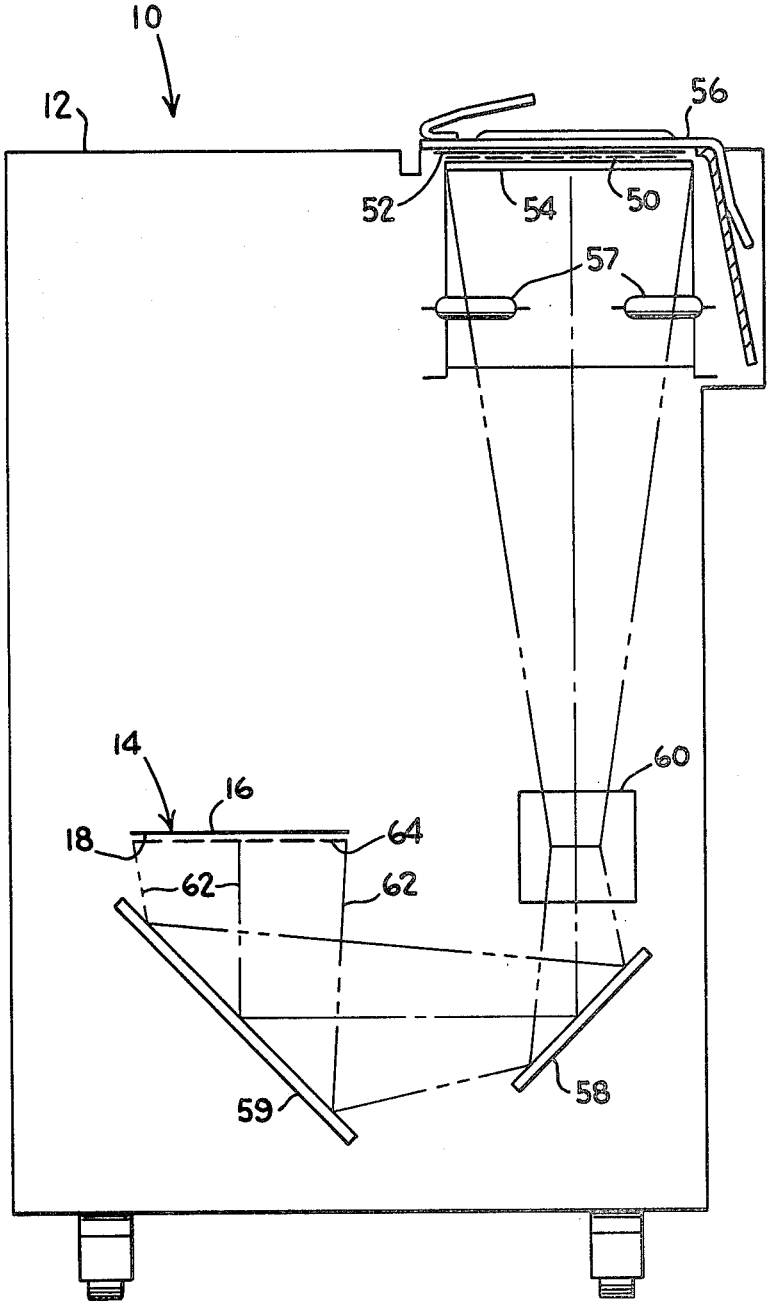
FIG. 2 is a cross-sectional, left side view, in elevation, of the electrostatic copier of FIG. 1, taken substantially along the line 2—2 thereof, showing a schematic diagram of the photoreceptor imaging apparatus of the copier.

At the imaging station 34 the processing means includes means for providing the photoreceptor 14, with information in the form of a graphic image 50 (FIG. 2) carried by a document 52 placed by the operator on a glass platen 54 secured to the copier's framework 12 beneath a cover 56. To that end, the processing means includes one or more electrically energizeable light sources 57, reflectors 58 and 59 and a lens 60 adapted by well-known means to cooperate with one another for flash illuminating the document 52 to expose the outer surface 18 of the photoreceptor 14 with light 62 modulated by the graphic-image 50. The graphic-image modulated light 62 (FIG. 1) from the reflector 59 causes the photoreceptor 14 to selectively conduct and dissipate sufficient charge 48 from the photoreceptor's outer surface 18 to provide the same with a developable electrostatic latent image 64.

At the developing station 36 (FIG. 1) the processing means includes a container 66 for locally holding a reusable supply of developing material 68, and developer material transporting means including a suitably driven elongated rotatable shaft 72 and an elongated permanent magnet 74 magnetically coupled to one another. The magnet 74 and shaft 72 are located on opposite sides of the photoreceptor 14 and suitably secured to the framework 12 so as to longitudinally extend parallel to one another, out of contact with the moving photoreceptor 14 and transverse to the photoreceptor's path of travel 26. The rotating shaft 72 carries developer material 68 from the container 66 into a suitably narrow space 76 between the shaft 72 and photoreceptor surface 18, wherein the magnetic field 78 of the magnet 74 brings carried developer material 68 into contact with the moving photoreceptor 14. As a result, some of the toner material of the carried developer material 68 adheres to the electrostatic latent image 64 so as to render the image 64 visible; thereby forming a transferable, developed image 80 on the outer surface 18 of the moving photoreceptor 14.

The developed image 80 (FIG. 1) is then transferred from the photoreceptor surface 18 to a suitable copy sheet 82 such as a sheet of paper or other image supporting substratum. To that end, the processing means includes means for suitably supporting the copy sheet stack 84, and copy sheet transporting means including a pair of suitably driven elongated rollers 86 cooperating with an elongated idler roller 88 and a pair of guide plates 90. The rollers 86 and 88 are oriented so as to longitudinally extend parallel to one another and transverse to the path of travel 26 of the moving photoreceptor 14, and are suitably secured to the framework 12 for rotation in engagement with successive copy sheets 82 to move the same from the stack 84 in a desired path of travel 92 on the guide plates 90 to the transferring station 38.

At the transferring station 38 (FIG. 1) the processing means includes an elongated, rotatable, idler shaft 94 suitably secured to the framework 12 so as to longitudinally extend parallel to the respective paths of travel, 26 and 92, of the moving photoreceptor 14 and copy sheet 82. The rotating shaft 94 is disposed in engagement with a moving copy sheet 82 and in sufficiently close proximity to the moving photoreceptor 14 to forceably urge a copy sheet 82 into intimate engagement with the image-bearing outer surface 18 of the moving photoreceptor 14 to form a developed graphic image 96 on the engaged copy sheet 82. Preferably the shaft 94 is electrically energized by well-known means to provide an electric field of suitable polarity between the shaft 94 and next adjacent roller 22, tending to aid in transferring toner from the developed image 80 to the engaged copy sheet 82.

The graphic image 96 (FIG. 1) is thereafter fused to the image-bearing copy sheet 82 through the application of heat to the image 96. To that end, the processing means includes an image bonding device such as a pair of suitably heated elongated rollers 98. The rollers 98 are disposed parallel to one another and suitably secured to the framework 12 so as to longitudinally extend transverse to the path of travel 92 of the moving image-bearing copy sheet 82. The rollers 98 are also suitably driven by well-known means in engagement with the image-bearing sheet of paper 82 for feeding the bonded-image-bearing copy sheet 82 to a receiving station 100. At the receiving station 100 the processing means includes a pair of suitably driven sheet feeding follers 102 adapted by well-known means to engage and feed bonded-image-bearing copy sheets 82 to a suitable hopper 104 for retrieval by the operator of the copier 10.

After the developed image 80 (FIG. 1) 14 is transferred to a copy sheet 82, the moving photoreceptor 14 is guided to the cleaning station 40 by the idler roller 22 next adjacent to the transfer roller 94. At the cleaning station 40 the processing means includes a lamp 106 and a suitably housed and driven rotating brush 108. The lamp 106 is suitably secured to the copier framework 12 and disposed in sufficiently close proximity to the outer surface 18 of the photoreceptor 14 to irradiate the photoconductive coating thereon in order to remove residual charge 48 from the coating. The brush 108 is suitably secured to the framework 12 so as to longitudinally extend transverse to the path of travel 26 of the moving photoreceptor 14 and rotate in engagement with the photoconductive coating on the outer surface 18 of the moving photoreceptor 14, for removing residual developer material 68 from the moving photoreceptor 14. The cleaned photoreceptor 14 is thereafter fed to the storage station 30.

At the storage station 30 (FIG. 1) the processing means includes storing apparatus which comprises means for temporarily supporting a major portion of the length of the photoreceptor 14 in the form of a plurality of interconnected, generally U-shaped, wavy, loops 110; which serve to reduce the overall length of the stored photoreceptor while avoiding the formation in the same of creases, crimps, margins or wrinkles, or the like.

Figure 4:
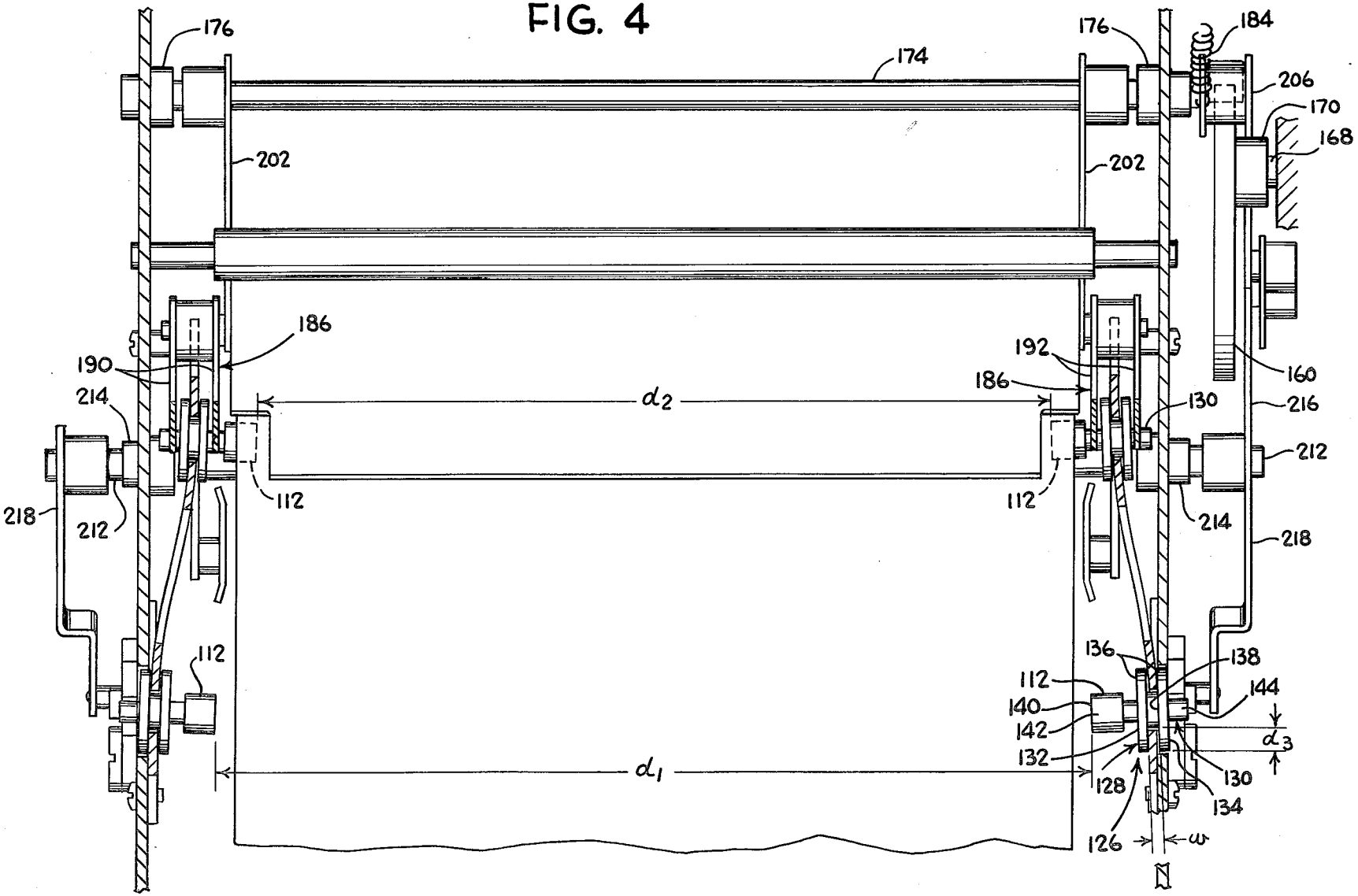
FIG. 4 is a fragmentary left end view, in elevation, of the photoreceptor storing apparatus of FIG. 3.
Figure 5:
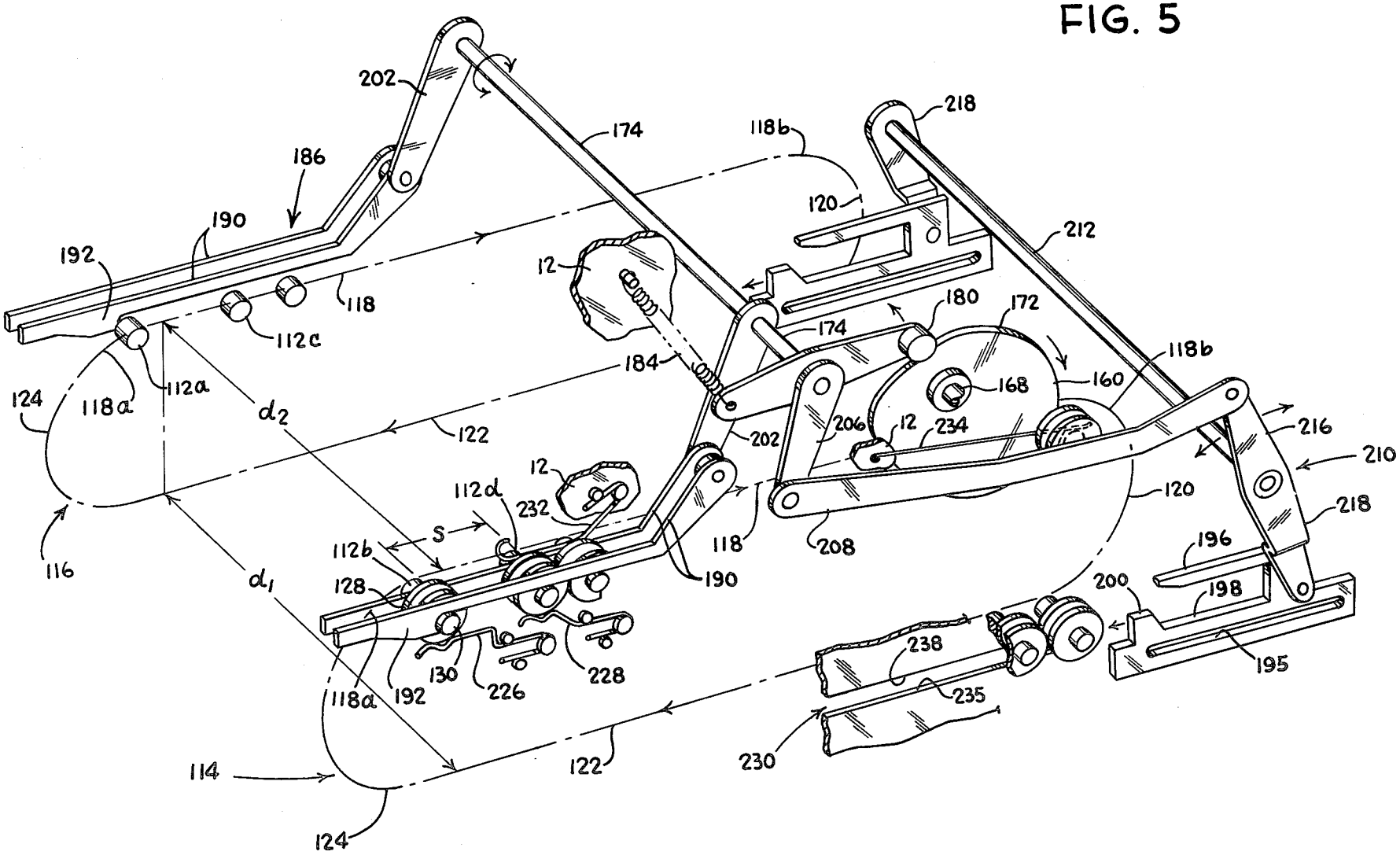
FIG. 5 is a fragmentary view, in perspective, of the photoreceptor storing apparatus of FIG. 3.
Figure 6:
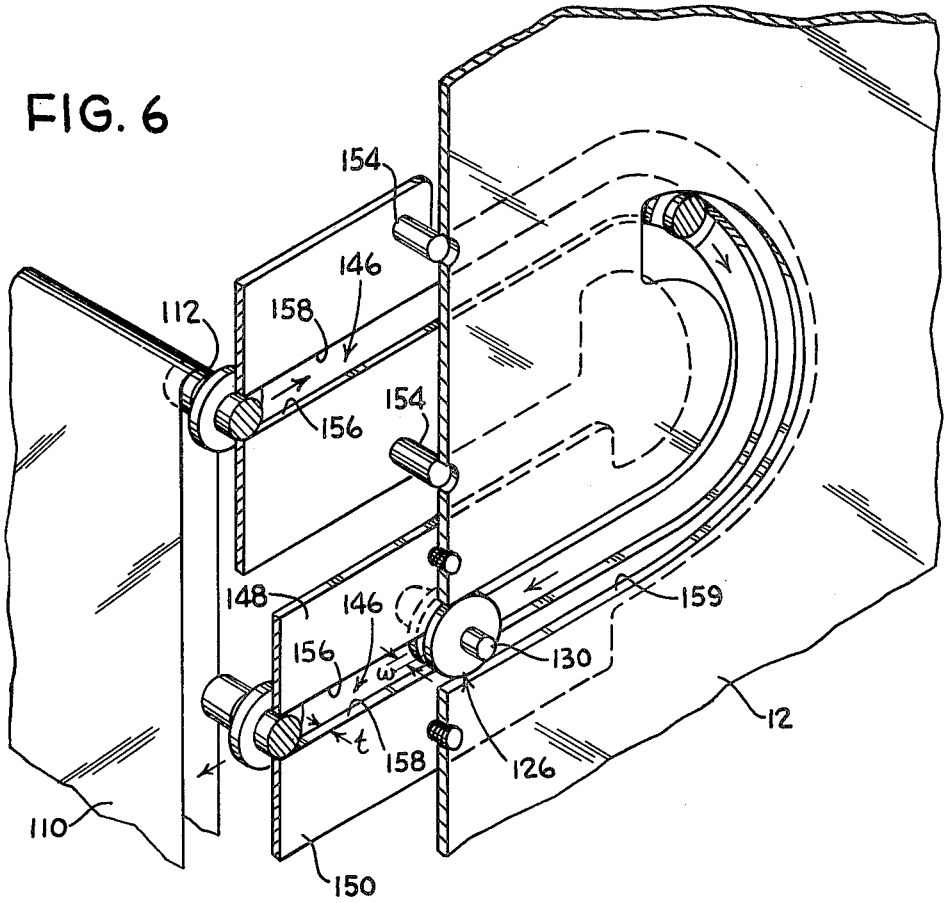
FIG. 6 is an enlarged, fragmentary view, in perspective of the photoreceptor storing apparatus off FIG. 3.
Figure 8:
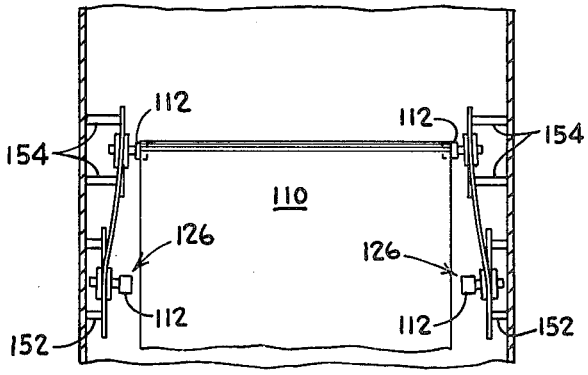
FIG. 8 is a reduced, fragmentary left end view, in elevation, of the photoreceptor storing apparatus of FIG. 3.
Figure 7:
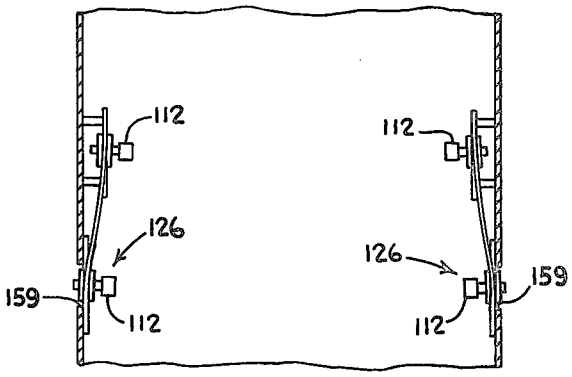
FIG. 7 is a modified, reduced, fragmentary left end view, in elevation, of the photoreceptor storing apparatus of FIG. 3.

For loop supporting purposes the storing apparatus includes a plurality of photoreceptor loop supports 112 (FIGS. 1 and 3–9) movable in two endless paths of travel, respectively generally designated 114 and 116 (FIG. 5). The paths 114 and 116, as described by the moving loop supports 112, are spaced apart and aligned abreast of each other, and respectively include an upper straight-line segment, generally desingated 118, having an upstream end 118A and a downstream end 118B. In addition, the paths of travel 114 and 116 each include a downwardly curvedly-extending downstream segment, generally designated 120, a lower straight-line segment, generally designated 122, and an upwardly curvedly-extending upstream segment, generally designated 124. Although the upper and lower straight-line path segments, 118 and 122, respectively extend parallel to each other, the lower path segments 122 are spaced apart from each other a greater distance "d" than the upper path segments 118 are spaced apart from each other, since the moving loop supports 112 (FIGS. 7 and 8) are spaced closer to one another when traveling in the upper portion of the storing apparatus than when traveling in the lower portion thereof. As a result the downstream path segments 120 (FIG. 5) respectively diverge from each other as they downwardly extend from the upper path segments 118 to the lower path segments 122, and, the upstream path segments respectively converge toward each other as they upwardly extend from the lower path segments 122 to the upper path segments 118.

The upper path segments 118 (FIG. 5) are spaced apart from each other a sufficient distance to permit feeding the photoreceptor 14 between the respective paths of travel 114 and 116. In addition, the path segments 118 are sufficiently spaced from each other to permit feeding the photoreceptor 14 into contact with the first pair of moving loop supports, 112A and 112B, of the respective upper path segments 118. Throughout the remainder of the respective upper path segments 118, the loop supports 112 (FIGS. 3–5) are spaced apart from each other a sufficient distance to permit the photoreceptor loops 110 (FIG. 3) to be disposed between the upper path segments 118 (FIG. 5) and to continuously hang from the loop supports 112 (FIG. 4) in the form of a series of inter-connected, inverted U-shaped loops 110 (FIG. 3), or upright U-shaped loops, depending on the observer's viewpoint. On the other hand, the loop supports 112 (FIG. 5) in the respective lower path segments 122 are spaced apart from each other a sufficient distance to permit the photoreceptor loops 110, hanging from the loop supports 112 in the upper path segment 118, to be disposed between and out of contact with the loop supports 112 in the lower path segments 122. Each of the loop supports 112 (FIG. 5) in each of the upper path segments 118 is movable abreast of a directly oppositely disposed loop support 112 in the other upper path segment 118 to form therewith successive loop support pairs, such as 112A and 112B, and 112C and 112D. Moreover, during movement of the loop supports 112 (FIG. 1) through their respective upper path segments 118, the loop supports 112 in each upper path segment 118 are disposed at equidistantly spaced intervals longitudinally of the length of the particular upper path segment 118. And, the loop supports 112 in each of the upper path segments 118 are preferably respectively separated from next adjacent loop supports 112 in the same segment 118 by a sufficient distance to promote both continuous separation of adjacent loops 110 from each other and continuous retention of the respective loops 110 in an open, U-shaped, configuration; so as to avoid abrasive, sliding surface-to-surface contact between opposed active surface portions, such as 18A and 18B, of the outer photoreceptor surface 18.

Figure 3:
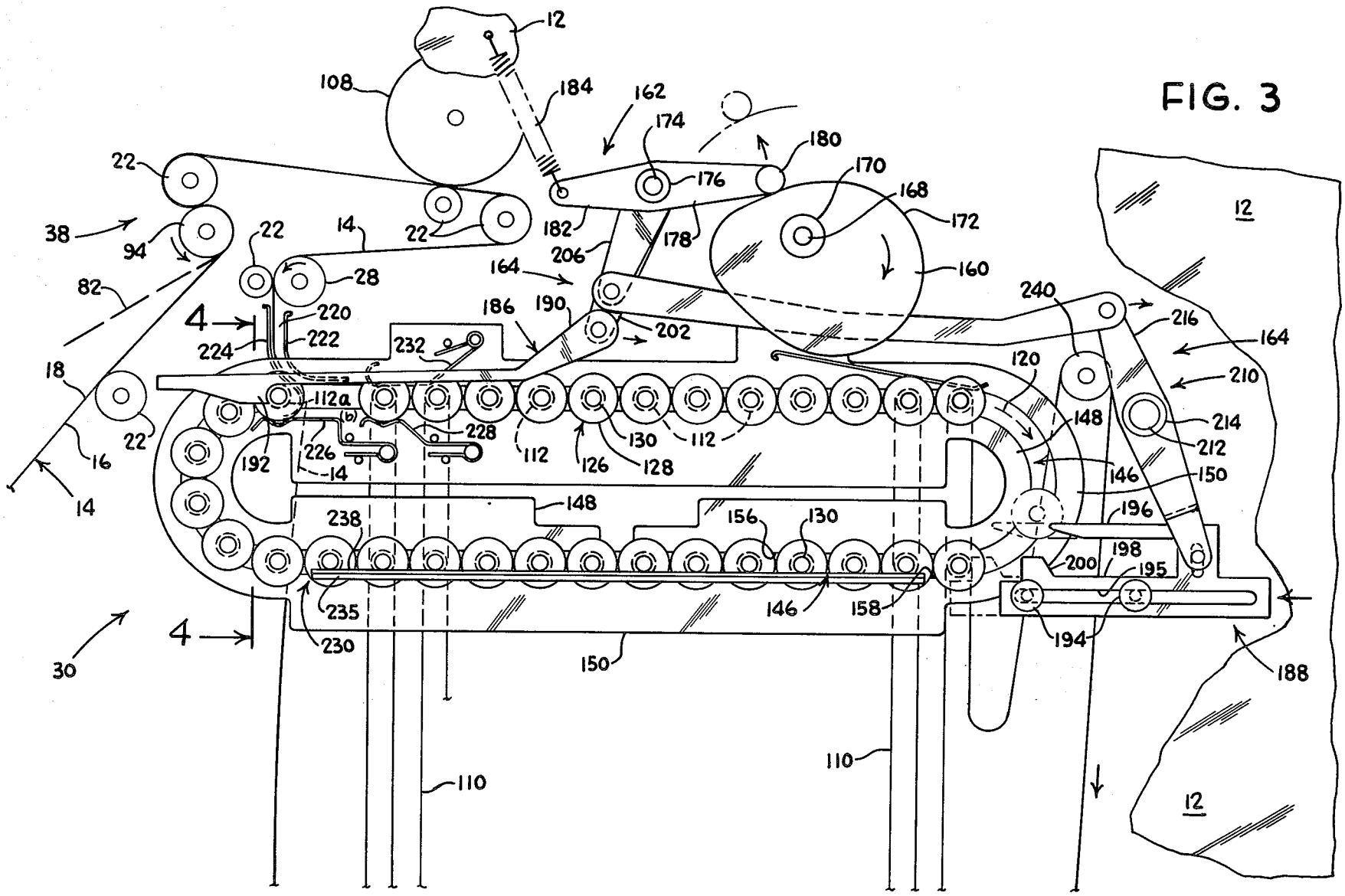
FIG. 3 is an enlarged, fragmentary view, in elevation, of an embodiment of the photoreceptor storing apparatus of the copier.

In the loop supporting apparatus of FIGS. 3 and 4, each of the loop supports 112 is an integral portion of a carrier 126 which also includes collar and post portions, respectively designated 128 and 130. The collars 128 (FIG. 4) are the circularly-shaped disk-like portions of the respective carriers 126. Each of the collars 128 has opposite sides 132 and 134, a circularly-extending outer surface 136 and an annularly-shaped channel 138. The channels 138 radially extend into the collars 128, from the outer surface 136 of the associated collar 128, to a depth "d" which is greater than the width "w" of the channel 138. The loop supports 112 are stub shaft portions of the respective carriers 126 which are of circular transverse cross-section, axially extend from side 132 of their associated collars 128 and have an enlarged free end 140. Each of the free ends 140 has a circularly-extending outer surface 142, which is of a lesser diameter than that of the collar's outer surface 136. The posts 130 are stub shaft portions of the respective carriers 126 which extend from side 134 of their associated collars 128. The posts 130 are of circular transverse cross-section and have a circularly-extending outer surface 144.

The storing apparatus further includes a pair of oppositely spaced endless tracks 146 (FIG. 3) on which a plurality of the carriers 126 are movably mounted. The tracks 146 define the loop support paths of travel, 114 and 116, and are respectively formed by an inner plate 148 and an outer plate 150. In the embodiment shown in FIG. 8, the plates 148 and 150 are suitably fixedly attached to the copier framework 123, as by means of standoffs 152 and 154, so as to dispose the upper straight-line portions of the respective tracks 146 parallel to each other, and above and closer to each other than the remainder of the tracks 146. To that end, the standoffs 154 are made longer than the standoffs 152, resulting in the opposite inner and outer plates 148 and 150 curvedly converging toward each other as they extend upwardly from the standoffs 152 to the standoffs 154. In the embodiments shown in FIGS. 3–7, for space saving purposes the lower portions of the inner and outer plates, 148 and 150 (FIG. 6), are directly attached to the framework 12, necessitating the provision in the framework 12 of an elongated, appropriately curved clearance openings 159, of sufficient transverse width, to accommodate movement of the carriers 126 out of contact with the plates 148 and 150. With this arrangement, the carriers 126, and particularly the posts 130 thereof, extend through the framework opening 159 throughout a major portion of their movement on the tracks 146. Each of the inner plates 148 respectively form the inner races 156 of the tracks 148, and the outer plates 150 respectively form the outer races 158 of the tracks 146. The transverse spacing between the adjacent races 156 and 158 of the respective tracks 146 is such that when the carriers 126 are mounted on the tracks 146 they are captured between the inner and outer races 156 and 158. On the other, the carriers 126 are sufficiently loosely mounted on the tracks 146, due to the thickness "t" of the plates 148 and 150 being less than the width "w" of the carrier channels 138, to permit movement thereon around the curvedly extending end portions of the tracks 146 without being overly laterally constrained by the associated plates 148 and 150 which act as guides for movement of the carriers 126.

For intermittently moving the supported loops 110, the storing apparatus includes means for moving the carriers 126 (FIGS. 3–5) and thus the loop supports 112; including a cam 160, suitably driven from the source of supply of motive power (not shown), cam follower means 162 and carrier actuating means 164.

The cam 160 (FIGS. 3–5) is suitably pivotably connected to the framework 12 for rotation in place, as by means of a pivot shaft 168 rotatably mounted in a bearing 170 suitably connected to the framework 12. The cam 160 includes an outer, peripherably-extending, cam surface 172 having a predetermined configuration for timely rotating the cam follower means 162 in opposite directions during each revolution of the cam 160. The cam follower means 162 includes an elongated upper, primary, drive shaft 174, which extends across and transverse to the path of travel 26 (FIG. 1) of the photoreceptor 14 (FIGS. 3–6) and is movably pivotably connected to the framework 12 for rotation in place, as by means of oppositely spaced and aligned bearings 176 suitably connected to the framework 12. The cam follower means 162 also includes a first arm portion 178, extending from the upper drive shaft 174 and toward the cam 160, which is provided with a roller 180 for contacting the cam surface 172; and a second arm portion 182, extending from the upper drive shaft 174 and away from the cam 160, which is provided with a tension spring 184 interconnecting the cam follower means 162 to the framework 12 for holding the cam follower roller 180 in contact with the cam surface 172.

The carrier actuating means 164 includes upper and lower oppositely reciprocable carrier actuators, respectively designated 186 and 188. The upper actuators 186 are each lengthwise slidably movable on top of the adjacent carriers 126, and include a pair of horizontally-extending, horizontally-adjacently spaced arms 190, each of which has a downwardly-extending finger portion 192. The lower carrier actuators 188 are each suitably slidably attached to the framework 12, as by means of support pins 194 extending through elongated slots 195 formed in the respective actuators 188, and respectively include first and second, horizontally extending, vertically-adjacently spaced arms, 196 and 198, the second of which, 198, has an upwardly-extending finger portion 200. In addition the carrier actuating means 164 includes a pair of oppositely spaced upper actuator drive arms 202, each of which has one end suitably adjustably-fixedly attached to the upper drive shaft 174 for rotation therewith, and the other end suitably pivotably attached to the next adjacently located upper carrier actuator 186. Further, the carrier actuating means 164 includes a primary, lower, actuator drive arm 206 having one end suitably adjustably-fixedly attached to the upper drive shaft 174 for rotation therewith; a push rod arm 208 having one end to which the other end of the actuator drive arm 206 is suitably pivotably attached; and rocker arm means 210 suitably pivotably attached to the other end of the push-rod arm 208. The rocker arm means 210 includes an elongated lower, secondary, drive shaft 212. The lower drive shaft 212 extends across and transverse to the path of travel 26 of the photoreceptor 14, parallel to the upper drive shaft 174 and is suitably pivotably attached to the framework 12 for rotation in the opposite direction to that of the upper drive shaft 174. To that end, the lower drive shaft 212 is mounted in a pair of oppositely spaced and aligned bearings 214 suitably connected to the framework 12. The rocker arm means 210 includes a driven arm 216, and a pair of oppositely spaced and aligned, secondary, lower actuator drive arms 218. The arms 218 respectively extend from the lower drive shaft 212 and are suitably pivotably attached to opposite lower carrier actuators 188.

At the upstream end 118A of the respective upper path segments 118 (FIG. 5) the storing apparatus preferably includes a curvedly-extending channel 220 (FIG. 3) formed by adjacently spaced and curvedly-extending members, respectively designated 222 and 224. The members 222 and 224 guide the moving photoreceptor 14 in a suitably curvedly-extending attitude relative to the loop supports 112A and 112B, to promote gently and non-abrasively hanging the photoreceptor 14 on the loop supports 112A and 112B.

The storing apparatus also comprises means for inhibiting movement of the carriers 126, including first and second carrier detent springs, respectively designated 226 and 228, one of each of which is located at the upstream end 118A of each of the upper path segments 118. The detent springs 226 and 228 are suitably anchored in place to the framework 12 and oriented so as to bear upwardly against, and resiliently engage, successive carriers 126 at the upstream end 118A of the associated upper path segment 118, so as to form an inter-carrier space "s" between the first and second detent spring-engaged carriers 126, to permnit insertion of the photoreceptor 14 between such carriers 126, permit proper formation of the loops 110 between such carriers 126, allow for separation of the surfaces 18A and 18B of a given loop 110 as it is being formed and hold the loop supports 112 of such carriers 126 against movement into contact with the photoreceptor 14 during at least a portion of the time it is being fed through the channel 220 and between the successive loop support pairs 112A–112B and 112C–112D, to initially form a given photoreceptor loop 110 (FIG. 1). In addition, at the upstream end 118A (FIG. 5) of each of the upper path segments 118, there is provided a bias spring 232 for clamping the just formed photoreceptor loop 110 against the adjacent loop supports 112 to prevent lengthwise movement into the space "s" between the aforesaid carriers 126 while the subsequent loop 110 is being formed.

In addition, at the downstream end 118B (FIG. 5) of each of the upper path segments 118, the means for inhibiting carrier movement includes a carrier bias spring 234. The bias springs 234 are each suitably anchored in place to the framework 12, and oriented so as to bear downwardly against, and continuously resiliently urge each of the carriers 126 on the upper straight-line portions of the respective tracks 146 in engagement with the respective next adjacent carriers 126 and against inadvertent downstream movement.

Further, as shown in FIG. 3, the means for inhibiting movement of the carriers 126 includes suitable means such as a pair of oppositely spaced, elongated members 230. The members 230 each includes a base portion 235, and a surface portion 238 made of a suitably resilient material such as a sponge-like resilient plastic material. The respective members 230 are suitably secured to the framework 12 adjacent to the lower straight-line portions as the respective tracks 146, and oriented with respect to the carriers 126 thereon, so that the surfaces 238 bear upwardly against the posts 130 of such carriers 126 to hold the same against inadvertent movement on the tracks 146.

Still further, beyond the downstream end 118B (FIG. 3) of the upper path segments 118, the storing apparatus includes suitable means 240 for restraining advancement of the photoreceptor 14 away from the storage station 30 so as to avoid inadvertent movement of the photoreceptor loops 110 within the storage station 30. For exemplary purposes, the restraining means 240 may be a curved plate (not shown), or a roller such as roller 22 (FIG. 1) adjacent to the storage station 30. The restraining means 240 is suitably secured to the framework 12 so as to extend transverse to the path of travel 26 of the photoreceptor 14 and either rotate in engagement with, or be held in stationary engagement with, the advancing photoreceptor 14.

In response to actuation of the copier control means (not shown) by the operator, the drive shaft 28 (FIG. 3) and cam 160 are rotated in synchronism with each other by the source of supply of motive power (not shown), such that the cam 160 intermittently rotates a single revolution for each, or a predetermined fraction of each, concurrent advancement of the photoreceptor 14 (FIG. 1) from the storage station 30, through the charging station 32, imaging station 34, developing station 36, transfer station 38 and cleaning station 40, and to the storage station 30. If the cam 160 (FIG. 3) is not rotated during a given advancement of the photoreceptor 14 by the drive shaft 28, the drive shaft 28 feeds the photoreceptor 14 through the curvedly-extending channel 220, to extend downwardly and to the right of the loop supports 112A–112B. On the other hand, if the cam 160 is rotated during a given advancement of the photoreceptor 14 by the drive shaft 28, the photoreceptor 14 is draped over the top of the loop supports 112A–112B to extend downwardly and to their left, since the moving loop supports 112A–112B are translated to the right, as hereinafter discussed, when the cam 160 is rotated.

With each revolution of the cam 160 (FIGS. 3 and 5) the cam surface 172 initially raises the cam follower roller 180, against the spring tension of the cam follower spring 184 to rotate the upper drive shaft 174, and thus the upper actuator drive arms 202 and primary lower actuator drive arm 206, counter-clockwise as viewed in FIGS. 3 and 5.

As the upper actuator drive arms 202 are rotated counter-clockwise, they directly slidably move the upper carrier actuators 186 and thus the respective pairs of actuator arms 190, to the right as viewed in FIGS. 3 and 5. As a result, the upper actuator finger portions 192 of each pair of arms 190, respectively engage the adjacent loop support 112 and post 130 of the carriers 126 being held in place by the first detent springs 226, and move such carriers 126 through the inter-carrier space "s" and into translating engagement with the carriers 126 being held in place by the second carrier detent springs 228, so as to displace each of the latter carriers 126, and thus the remainder of the carriers 126 on the upper straight-line portions of the respective tracks 146, a predetermined downstream distance against the spring tension of the respective springs 228 and 234. The predetermined downstream distance each of the carriers 126 is thus translated, is a distance which is equal to the diameter of the respective carrier collars 128. And, such translation is accompanied by sufficient displacement of the carriers 126 engaged by the respective second bias springs 234 to cause such carriers 126 to roll downwardly, under the influences of gravity, on the curvedly-extending downstream portions of the respective tracks 146.

As the lower actuator drive arm 206 is rotated counter-clockwise, as viewed in FIGS. 3 and 5, it moves the push-rod arm 288 connected thereto to the right. Whereupon the push-rod arm 208 rotates the rocker arm means 210, and thus the lower drive shaft 212 and respective lower activator drive arms 218, clockwise; thereby causing in the lower drive arms 218 to directly slidably move the respective lower carrier actuators 188, and thus the respective actuator arms 196 and 198, from their respective rest positions, as shown in FIGS. 3 and 5, and to the left. As the respective lower actuators 188 move to the left, the respective first arms 196 are moved into the respective paths of travel of the carriers 126 which are displaced from engagement by the respective second bias springs 234, thereby interrupting the downward fall of such carriers 126, temporarily holding them out of alignment with the carriers 126 on the lower straight-line portions of the associated tracks 146 and preventing them from falling into engagement with the second lower actuator arm 198. In addition, as the respective lower actuators 188 are moved to the left, the finger portions 200 of each of the second arms 198 respectively engage the adjacent carrier post 130 and translate such carriers 126, together with the remainder of the carriers 126 on the lower straight-line portions of the respective tracks 146 and the carriers 126 on the curvedly-extending upstream portion of the respective tracks, against the tension of the restraining means surface 238 (FIG. 1). The predetermined upstream distance each of the carriers 126 (FIGS. 3 and 5) is thus translated, is a distance which is equal to the distance of the respective carrier collars 128. And, such translation is accompanied by movement of a carrier 126 on each of the tracks 146 into position for engagement by the first detent spring 226, to take the place of the carriers 126 displaced therefrom by the upper carrier actuators 186.

As the cam 160 continues to rotate, the cam surface 172 permits the cam follower spring 184 to lower the cam follower roller 180, thereby rotating the upper drive shaft 174, and thus the upper and lower actuator drive arms 202, and 206, clockwise as viewed in FIGS. 3–6.

As the actuator drive arms 202 are rotated clockwise, they directly slidably move the respective upper carrier atuators 186, and thus the respective pairs of actuator arms 190, to the left as viewed in FIGS. 3 and 5. Whereupon the finger portions 192, of each pair of arms 190 respectively disengage the carriers 126, held in place by the second detent springs 228 and move them to the left, through the inter-carrier space "s", over the carriers 126 then being held in place by the first detent springs 226 and to the rest position shown in FIGS. 3 and 5.

As the actuator drive arm 206 is rotated clockwise, as viewed in FIGS. 3 and 5, it moves the push-rod arm 208 connected thereto to the left. Whereupon the push-rod arm 208 rotates the rocker arm means 210, and thus the lower drive shaft 212 and respective lower drive arms 218, counter-clockwise; thereby causing the lower drive arms 218 to directly slidably move the respective lower carrier actuators 188, and thus the respective arms 196 and 198, to the right and back to their respective rest positions as shown in FIGS. 3 and 5. As the respective lower actuators 188 are moved to the right the finger portions 200, of each of the second arms 198, respectively disengage the adjacent carriers 126 and return to the rest position shown in FIGS. 3–5. In addition, as the respective lower actuators 188 move to the right, the first arms 196 are moved out of the respective paths of travel of the carriers 126 temporarily held thereby, permitting such carriers 126 to roll downwardly, under the influence of gravity, and into alignment with the remainder of the carriers 126 on the lower straight-line portion of the tracks 146.

Accordingly, with each revolution of the cam 160, the upper and lower carrier actuators 186 and 188 are reciprocated in unison with each other, but in opposite directions from one another and such that the upper and lower carriers 186 and 188 are respectively intermittently moved a predetermined distance in their respective paths of travel and in synchronism with advancement of the photoreceptor 14 to the carriers 126; as a result of which, during each revolution of the cam 160 at least a portion of a photoreceptor loop 110 is formed between successive spaced apart carrier loop supports, 112A and 112B, and the photoreceptor loops 110 hanging on the remaining loop supports 112 are each incrementally translated a downstream distance equal to the diameter of the respective carrier collars 128. Of course, as the loops 110 are being translated downstream on the loop supports 112 they are in static storage in the sense that the looped length of the photoreceptor 14 is not being lengthwise moved on the loop supports 112.

Figure 9:
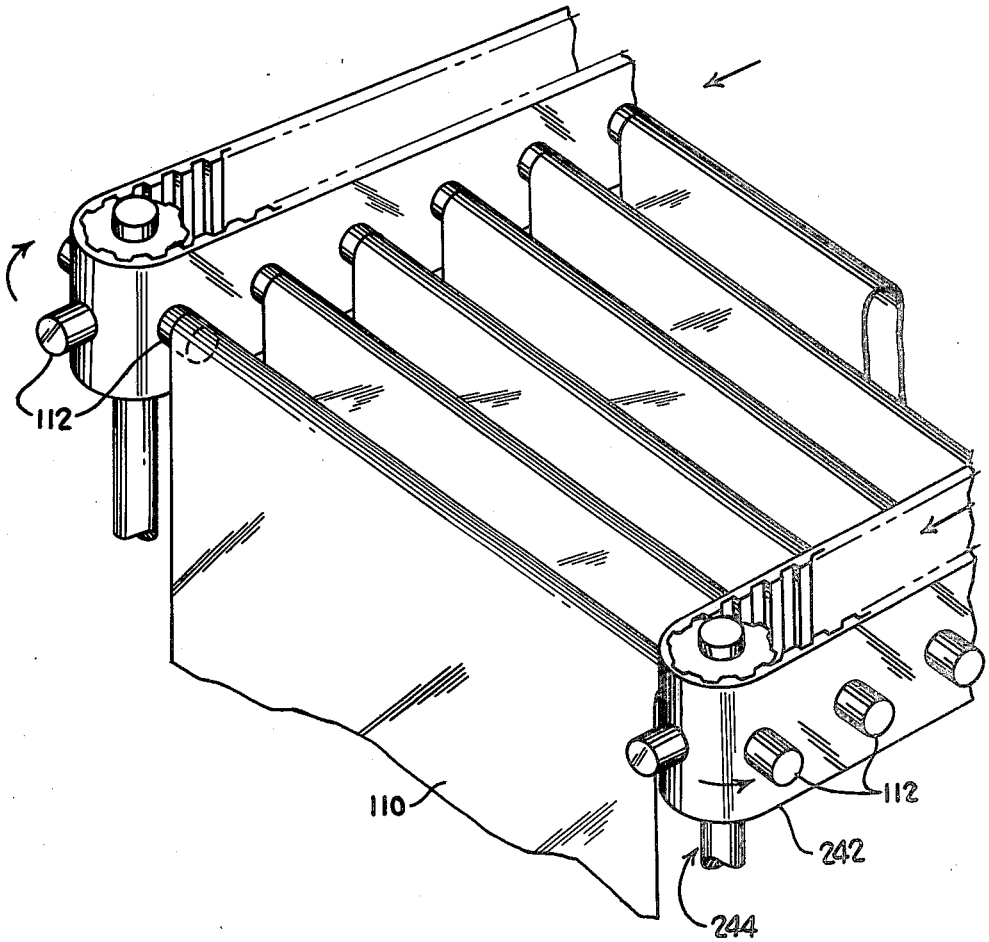
FIG. 9 is a fragmentary view, in perspective of another embodiment of the photoreceptor storing apparatus of the copier.

The simplified embodiment shown in FIG. 9 differs from the embodiments shown in FIGS. 3–8 in that the carrier means includes a pair of endless gear belts 242 from which the equidistantly spaced loop supports 112 laterally extend. For intermittently moving the belts 242 and thus the loop supports 112, each of the belts 242 is suitably endlessly looped about an elongated drive shaft 244 and idler shaft (not shown). The drive shafts 244 and idler shafts extend parallel to each other and are suitably secured to the framework 12 so as to longitudinally extend perpendicular to the path of travel of the photoreceptor 14 through the storage station 30. And, the drive shafts 244 are each suitably driven from the source of supply of motive power (not shown) for intermittent movement of the belts 242 in correspondence to movement of the cam 160 (FIG. 3–6); whereby the photoreceptor loops 110 are moved through the storage station 30 in timed relation to advancement of the photoreceptor 14 through the remaining processing stations 32, 34, 36, 38 and 40 of the copier.

In accordance with the objects of the invention there has been described an electrostatic copier including means for storing a major portion of a photoreceptor in the form of a plurality of wavy loops.

Inasmuch as certain changes may be made in the above described invention without departing from the spirit and scope of the same, it is intended that all matter contained in the above description or shown in the accompanying drawings shall be interpreted in an illustrative rather than limiting sense. And, it is intended that the following claims be interpreted to cover all the generic and specific features of the invention herein described.

What is claimed is:

1. A copier comprising:

(a) a photoreceptor, said photoreceptor comprising a movable flexible endless web having a light-sensitive outer surface and a non-image inner surface;

(b) means for forming an image on said outer surface of said photoreceptor;

(c) means for transferring the image from the photoreceptor to a copy sheet;

(d) means for storing a major portion of the photoreceptor in the form of a plurality of wavy U-shaped loops, said storing means including means for spacing the respective photoreceptor loops apart from next adjacent loops said spacing means including a plurality of pairs of spaced apart means for edgewise supporting the inner surface of said photoreceptor from the top of said loops in order to form said loops with the bottom of said loops being unsupported;

(e) means for intermittently moving said loops laterally in unison a predetermined distance through said storing means without moving said photoreceptor longitudinally through said storing means; and (f) said means for spacing said photoreceptor loops including a plurality of movable carriers adapted to support said photoreceptor loops, each of said photoreceptor loops supported by at least one of said carriers, and said means for intermittently moving said loops including means for intermittently actuating said carriers.

2. The copier according to claim 1, wherein said spacing means includes a first plurality of carriers movable in a first endless path of travel and a second plurality of carriers movable in a second endless path of travel, said paths of travel spaced apart from each other, and each of said photoreceptor loops supported by at least one of said loop supports in each of said first and second paths of travel.

3. A copier comprising:

(a) a photoreceptor, said photoreceptor comprising a movable flexible endless web;

(b) means for forming an image on said photoreceptor;

(c) means for transferring the image from the photoreceptor to a copy sheet;

(d) means for storing a major portion of the photoreceptor in the form of a plurality of wavy U-shaped loops, said storing means including means for spacing the respective photoreceptor loops apart from next adjacent loops, said spacing means including a plurality of pairs of spaced apart means for edgewise supporting said photoreceptor in order to form said loops;

(e) means for intermittently moving said loops in unison a predetermined distance through said storing means;

(f) said means for spacing said photoreceptor loops including a plurality of movable carriers adapted to support said photoreceptor loops, each of said photoreceptor loops supported by at least one of said carriers, and said means for intermittently moving said loops including means for intermittently actuating said carriers;

(g) said spacing means includes first and second endless tracks and a plurality of carriers mounted for movement on each of said tracks, a first plurality of loop supports extending from the carriers mounted on said first track, and a second plurality of loop supports extending from the carriers mounted on said second track, said first and second tracks spaced abreast of each other and defining said first and second paths of travel.

4. A copier comprising:

(a) a photoreceptor, said photoreceptor comprising a movable flexible endless web;

(b) means for forming an image on said photoreceptor;

(c) means for transferring the image from the photoreceptor to a copy sheet;

(d) means for storing a major portion of the photoreceptor in the form of a plurality of wavy U-shaped loops, said storing means including means for spacing the respective photoreceptor loops apart from next adjacent loops, said spacing means including a plurality of pairs of spaced apart means for edgewise supporting said photoreceptor in order to form said loops;

(e) means for intermittently moving said loops in unison a predetermined distance through said storing means;

(f) said means for spacing said photoreceptor loops including a plurality of movable carriers adapted to support said photoreceptor loops, each of said photoreceptor loops supported by at least one of said carriers, and said means for intermittently moving said loops including means for intermittently actuating said carriers;

(g) means for concurrently advancing said photoreceptor from the storing means and through the image forming and image transferring means and back to the storing means, and said means for intermittently actuating said carriers includes means operable in timed relation with said advancing means.

5. A copier comprising:

(a) a photoreceptor, said photoreceptor comprising a flexible endless web having a light-sensitive outer surface and a non-image inner surface;

(b) a plurality of photoreceptor processing instrumentalities arranged in a predetermined closed loop path through which said photoreceptor moves for processing by said instrumentalities for making copies;

(c) one of said instrumentalities being a photoreceptor storage means which includes:

(1) a plurality of pairs of spaced apart means for edgewise supporting on said inner surface a major portion of the length of said photoreceptor in order to form a plurality of discrete loops, which are supported on the top edges thereof and unsupported on the bottom of said loops, respectively spaced from next adjacent loops and (2) actuating means for intermittently translating said loops laterally in unison a predetermined distance through said photoreceptor storage means without moving said loops longitudinally through said storage means;

(d) feeding means for withdrawing said photoreceptor from said storage means, advancing said photoreceptor through each of said processing instrumentalities other than said storage means and returning said photoreceptor to said storage means; and (e) said actuating means and said feeding means being operable in synchronism with one another whereby said loops are translated through said storage means in synchronism with the rate at which said photoreceptor is withdrawn from and returned to said storage means by said feeding means.

6. A copier comprising:

(a) a photoreceptor, said photoreceptor comprising an endless flexible web;

(b) a plurality of photoreceptor processing stations, one of said stations being a storage station;

(c) storage means at the storage station including means for supporting a major portion of the length of said photoreceptor in the form of a plurality of wavy U-shaped loops;

(d) means for advancing substantially equal lesser portions of the length of said photoreceptor from the storage station and through each of said processing stations other than the storage station and back to the storage station;

(e) said storage means including means for intermittently moving said photoreceptor loops through said storage station; and (f) said supporting means including a plurality of belts, and said means for intermittently moving said photoreceptor loops including means for moving said belts.

7. A copier comprising:

(a) a photoreceptor, said photoreceptor comprising a flexible endless web;

(b) a plurality of photoreceptor processing stations, one of said stations being a storage station;

(c) means for concurrently advancing substantially equal increments of the length of the photoreceptor to and from the storage station and through each of said processing stations other than the storage station;

(d) means for storing a major portion of the length of the photoreceptor at the storage station, said storing means including means for supporting said major length of photoreceptor in the form of a plurality of loops, and said storing means including means operable in timed relationship with advancement of the photoreceptor to and from the storage station for intermittently moving said photoreceptor loops through said storage station; and (e) said supporting means including first and second endless belts each having a plurality of loop supports extending therefrom, said first and second belts spaced abreast of each other and defining first and second paths of travel, and said means for intermittently moving said photoreceptor loops including means for intermittently moving said belts and thus said loop supports in their respective paths of travel.

8. A copier comprising:

(a) a photoreceptor, said photoreceptor comprising a movable flexible endless web;

(b) means for forming an image on said photoreceptor;

(c) means for transferring the image from the photoreceptor to a copy sheet;

(d) means for storing a major portion of the photoreceptor in the form of a plurality of wavy U-shaped loops, said storing means including means for spacing the respective photoreceptor loops apart from next adjacent loops;

(e) means for intermittently moving said photoreceptor loops through said storing means; and (f) said means for spacing said photoreceptor loops including belt means, said belt means including a plurality of loop supports spaced from each other, each of said photoreceptor loops supported by at least one of said loop supports, and said means for intermittently moving said photoreceptor loops including means for intermittently moving said belt means.

* * * * *

UNITED STATES PATENT AND TRADEMARK OFFICE

CERTIFICATE OF CORRECTION

PATENT NO. : 4,173,409

DATED : November 6, 1979

INVENTOR(S) : James E. Genthe, Douglas I. Morrison

It is certified that error appears in the above-identified patent and that said Letters Patent are hereby corrected as shown below:

Claim 2, line 7, change "loop supports" to -- carriers --.

Signed and Sealed this

*Twenty-first* Day of *December 1982*

[SEAL]

*Attest:*

GERALD J. MOSSINGHOFF

*Attesting Officer*

*Commissioner of Patents and Trademarks*